US007422451B2

(12) United States Patent
Chen et al.

(10) Patent No.: US 7,422,451 B2
(45) Date of Patent: Sep. 9, 2008

(54) ELECTRICAL CONNECTOR WITH GROUND CONTACTS

(75) Inventors: Zhi-Qiang Chen, Kunshan (CN); Bin Peng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/893,289

(22) Filed: Aug. 15, 2007

(65) Prior Publication Data

US 2008/0045055 A1 Feb. 21, 2008

(51) Int. Cl.
*H01R 4/66* (2006.01)

(52) U.S. Cl. ..... 439/101

(58) Field of Classification Search ..... 439/224, 439/500, 660, 101, 682
See application file for complete search history.

(56) References Cited

U.S. PATENT DOCUMENTS

| | | | | |
|---|---|---|---|---|
| 5,356,300 | A | 10/1994 | Whitaker | |
| 6,027,353 | A * | 2/2000 | Kamagai | 439/224 |
| 6,171,126 | B1 | 1/2001 | Hon Hai | |
| 6,461,178 | B1 * | 10/2002 | Fu | 439/224 |
| 6,551,143 | B2 * | 4/2003 | Tanaka et al. | 439/682 |

* cited by examiner

*Primary Examiner*—Phuong K Dinh
(74) *Attorney, Agent, or Firm*—Wei Te Chung

(57) ABSTRACT

An electrical connector assembly includes a socket (1) and a header (2), each including an insulating housing (11,21), a plurality of contacts (12,22) and a pair of grounding contact (13,23). The housing of header defines a pair of barriers (214) parallel to the header contact and a groove (2142) on an outer face of each barrier to receive one grounding header contact (23). When the header and the socket are mated with each other, the barrier is inserted into socket first, and the grounding contacts are electrically connected together before the contacts of the header and the socket.

4 Claims, 4 Drawing Sheets

ELECTRICAL CONNECTOR WITH GROUND CONTACTS

BACKGROUND OF THE INVENTION

1. Field of the invention

The present invention relates to an electrical connector with ground contacts thereof.

2. Description of Related Art

According to U.S. Pat. No. 6,027,353, a known connector for connecting battery units includes a socket and a header mating with each other. The header has multiple contacts projecting forwards from the insulating housing with fixed intervals along the longitudinal direction of the housing. A pair of contacts respectively at opposite ends of the header, which is wider and longer than the remainder, server as guiding posts and grounding terminals simultaneously. The connection of the grounding terminals is established before the remainder when the header and socket are engaged together, which provides an improved electrical safety.

However, the grounding terminals are formed without any supporting portion along its upper, bottom and front edges, which will result in breakage of the grounding terminals when the grounding terminal operates as a guiding post.

Therefore, an improved electrical connector is desired to overcome the disadvantages of the prior arts.

SUMMARY OF THE INVENTION

An object of the present invention is to provide an electrical connector with a grounding contact on a barrier.

In order to achieve above-mentioned object, an electrical connector assembly comprises a header and a socket. The header comprises an insulating housing defining at least one barrier unitarily extending upwards therefrom, a plurality of header contacts which are blade shaped, retained in the housing and arranged parallel to the at least one barrier, and at least one header grounding contact retained on one side of the barriers. The socket matable with the header comprises socket contacts and at least one socket grounding contact mated with corresponding header contact and header grounding contact, and insulating housing defining socket-contact-receiving recesses and socket-grounding-receiving recesses parallel to each other. When the header and the socket are mated with each other, the at least one barrier is inserted into corresponding socket-grounding-receiving recess, and the grounding contacts are electrically connected together before the header contacts and the socket contacts.

Other objects, advantages and novel features of the present invention will become more apparent from the following detailed description of the present embodiment when taken in conjunction with the accompanying drawings.

DETAILED DESCRIPTION OF THE INVENTION

Figure 1:
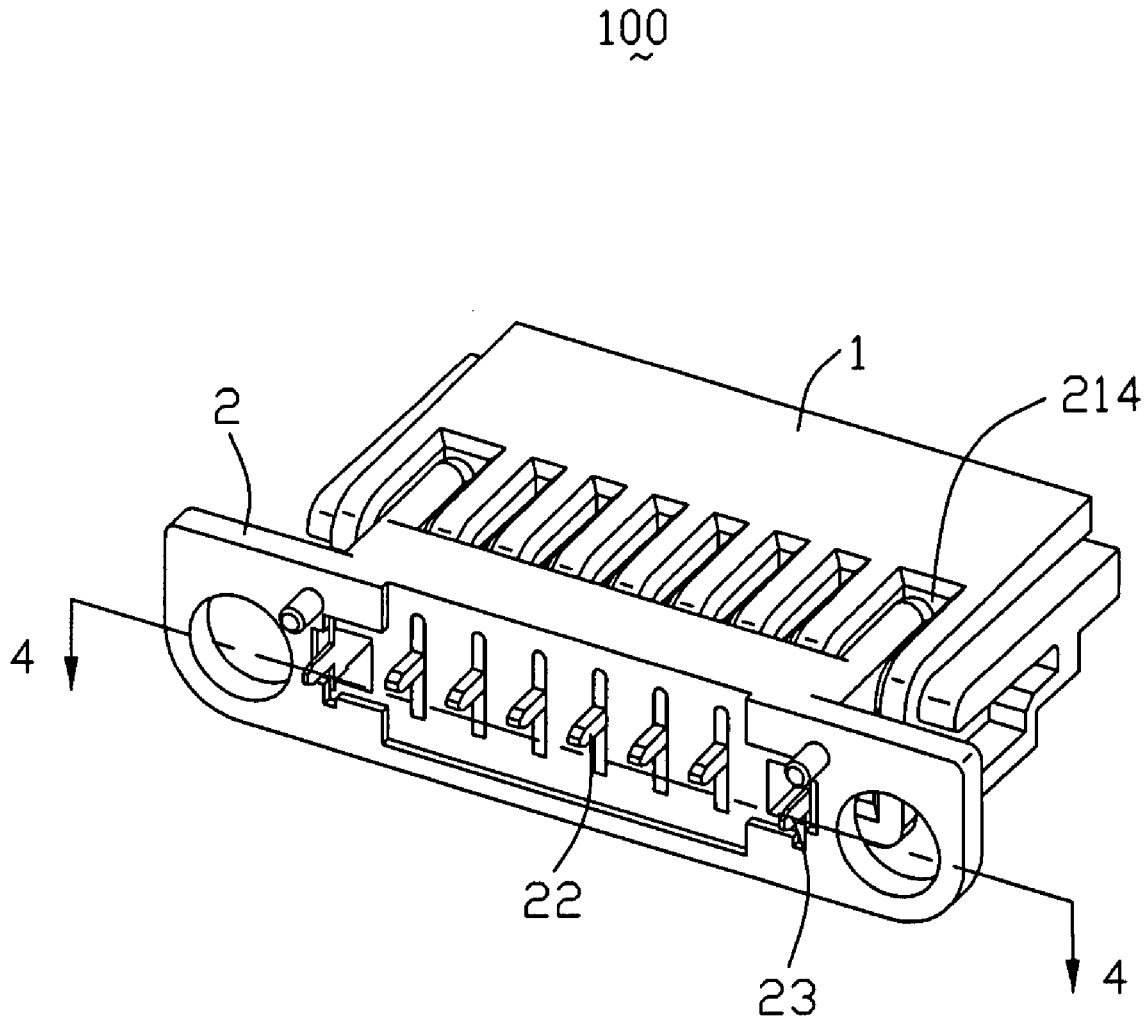
FIG. 1 is a perspective view of a header and a socket mated together in accordance with the present invention.

Reference will now be made to the drawing figures to describe the preferred embodiment of the present invention in detail.

Figure 2:
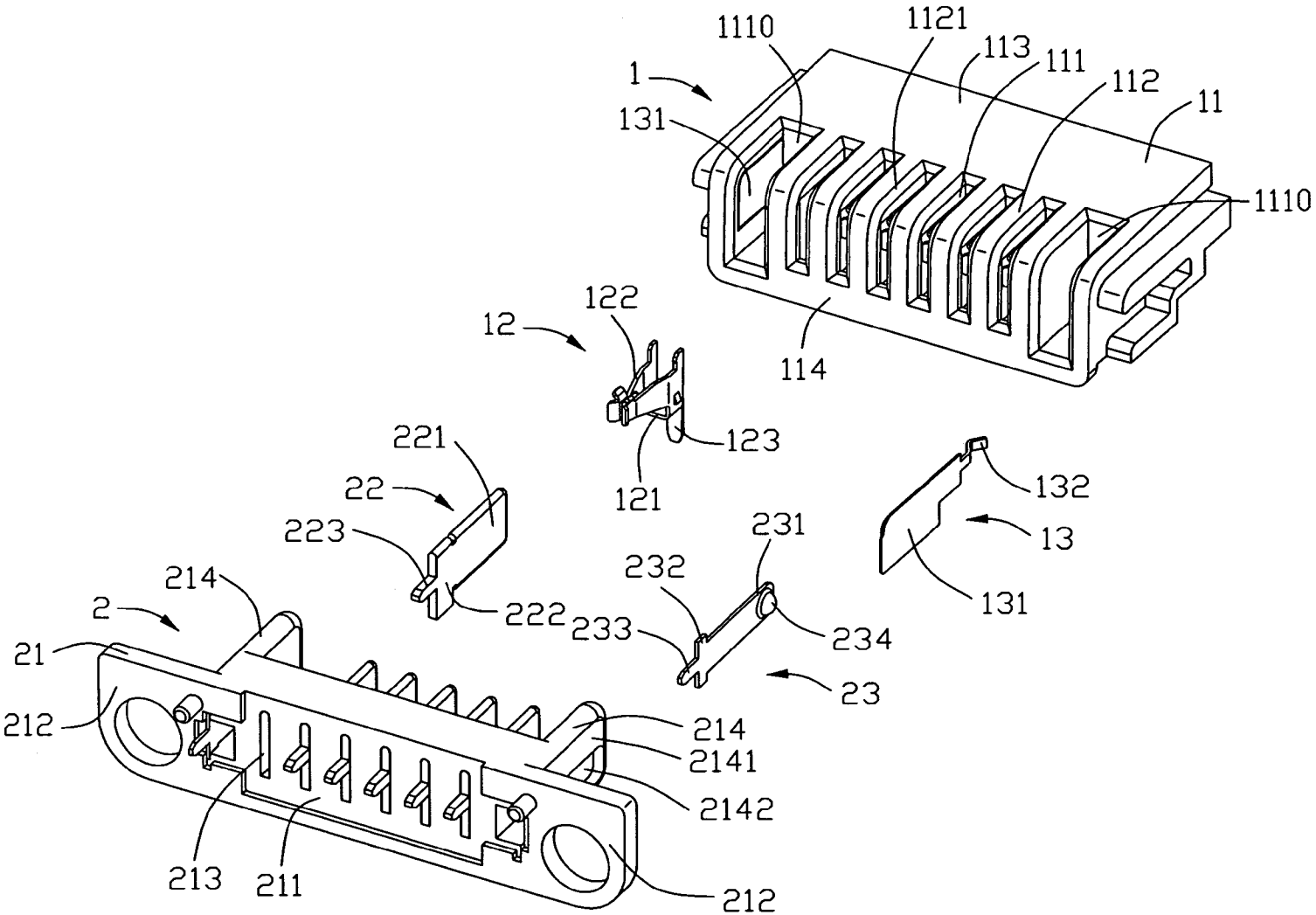
FIG. 2 is an exploded perspective view of the header and the socket shown in FIG. 1.

Referring to FIGS. 1-2, an electrical connector assembly 100 in accordance with the embodiment of the present invention comprises a socket 1 and a header 2, each of which comprises an insulating housing 11/21, multiple contacts 12/22 and a pair of grounding contacts 13/23.

Referring to FIG. 2, the insulating housing 11 of the socket 1 is of rectangle shape and eight recesses 111 are arranged along an elongated direction of the housing. The recesses 111 are opened to a top surface 113 and a front surface 114 and intersect at an intersection of the two surfaces, i.e. each recess 111 is recessed inwards from two adjacent and perpendicular surfaces of the housing and a rib 112 is formed between two adjacent recesses 111. Two end recesses 1110 respectively at opposite ends of the housing, each being wider and longer than the remainder, are used to receive grounding contacts 13 and the remainder are used to receive contacts 12, such as power and signal contacts.

Each socket contact 12 used to transmit power or signal, comprises retention section 121 retained in the housing, a pair of resilient arm section 122 and a leg section 123. The resilient arm section 122 are received in the remainder recess (socket-contact-receiving recesses 111), the leg section 123 extending out of the housing. Each socket grounding contact 13 of the pair comprises a blade shaped contact section 131 and a leg section 132 extending from the contact section. The socket grounding contacts 13 are received in the end recesses 1110 (socket-grounding-receiving recesses), wherein the blade shaped contact section 131 is abutting against an inside of the end recess 1110, in other word, against an inside surface of rib 112.

Figure 3:
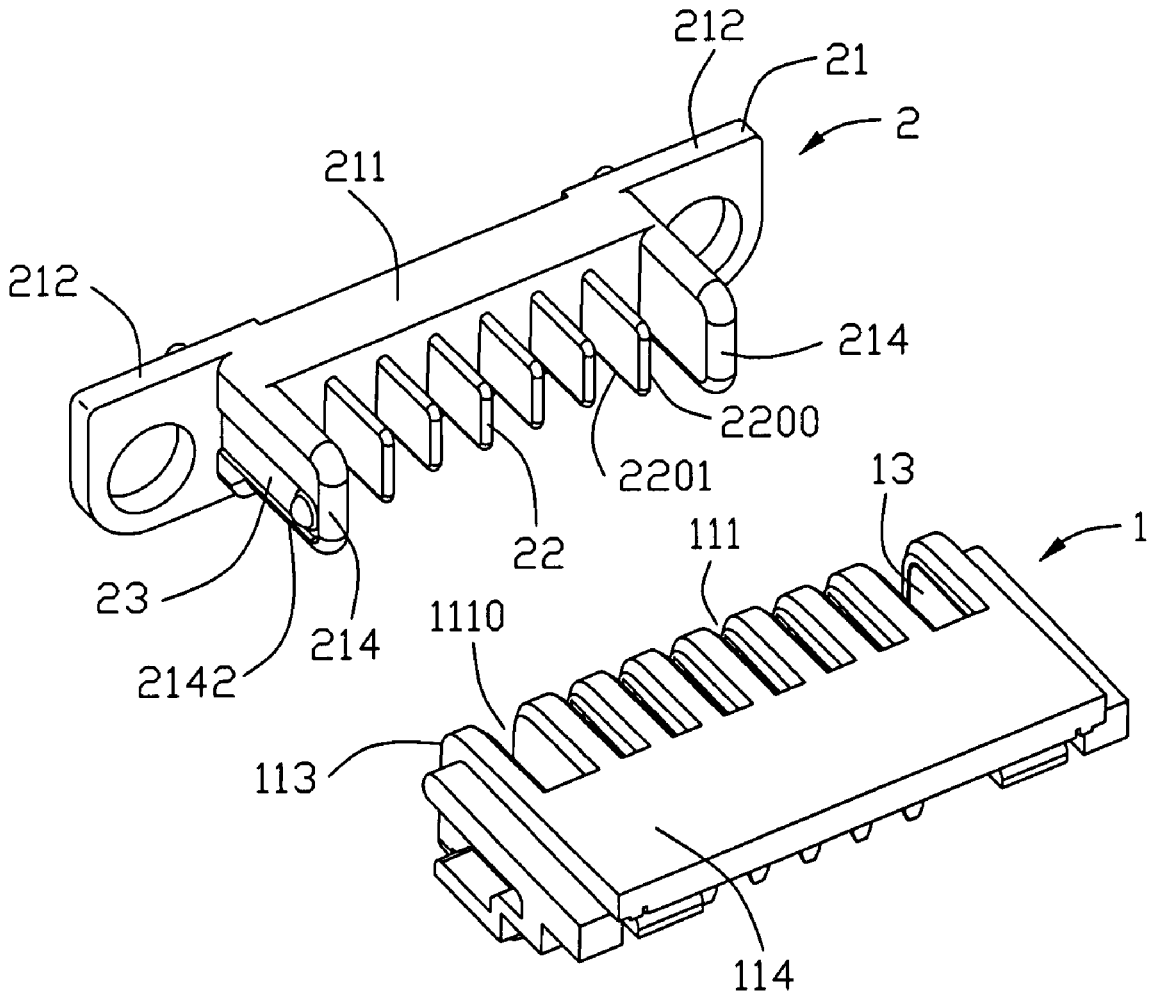
FIG. 3 is a perspective view of the header and socket before mating.

The insulating housing 21 of header 2 is rectangular and has a base portion 211 for mounting on a PCB and a pair of barriers 214 unitarily extending upwards from one surface of the base portion. The base portion 211 is mounting on a PCB by an end mounting portion 212 parallel extending outwards beyond the barriers. The barrier 214 has a groove 2142 on outer surface 2141 thereof, the groove opens outwards and extends through the base portion 211 along the extending direction of the barrier. Each of the header contacts 22 is of blade shape and comprises a retention section 222, a blade shaped contact section 221 and a leg section 223. The retention section 222 is retained in the contact-receiving passages 213 through the base portion and the contact section 221 extends upwards along the extending direction of barriers. The six contact sections 221 are arranged between the two barriers 214, and parallel spaced apart with a predetermined distance. Each barrier is thicker along an elongate direction of the housing, longer along the extending direction and wider along a third direction perpendicular to said two directions than each contact section 221 of the header contact, which is used to a guiding function. The header grounding contact 23 is of blade shape and comprises a retention section 232, a contact section 231 and a leg section 233. The contact section 231 has a contact projection 234 projecting outwards. As shown in FIG. 3, the grounding contact 23 is received in the groove 2142 with the leg extending out of the housing. The contact section of the grounding contact is longer than the contact section of the header contact, which will get an electrical safety by establishing a first connection to corresponding socket grounding contacts. Alternatively, the groove 214 might be provided on an inside surface of the barriers.

The socket 1 can be inserted into the header 2 by two forms. The header contacts 22 and the barriers 214 are inserted into the recesses 111 along the extending direction of the barriers, i.e. the front end of the contacts and barriers are inserted into the recesses from the front surface 113 of the socket 1. The barriers are first inserted into the socket-grounding-receiving recess 1110 for a guiding function and the header grounding contact 23 are electrically connected to the socket grounding contacts 13 before the contact 22, 12 resulting from the barrier 214 and header grounding contacts 23 extending beyond the front end 2200 of the header contact 22. Alternatively, The header contacts 22 and the barriers 214 are inserted into the recesses 111 along a second direction, i.e. the bottom edge perpendicular to the front end of the contacts and barriers are inserted into the recess from the top surface 114 of the socket 1. The groove 2142 is adjacent to the bottom edge of the contact so as to the header grounding contact 23 received in the groove 2142 extends downwards beyond the bottom edge 2201 of the contact 22, thereby the grounding contact 13, 23 are electrically connected before the contact 12, 22.

Figure 4:
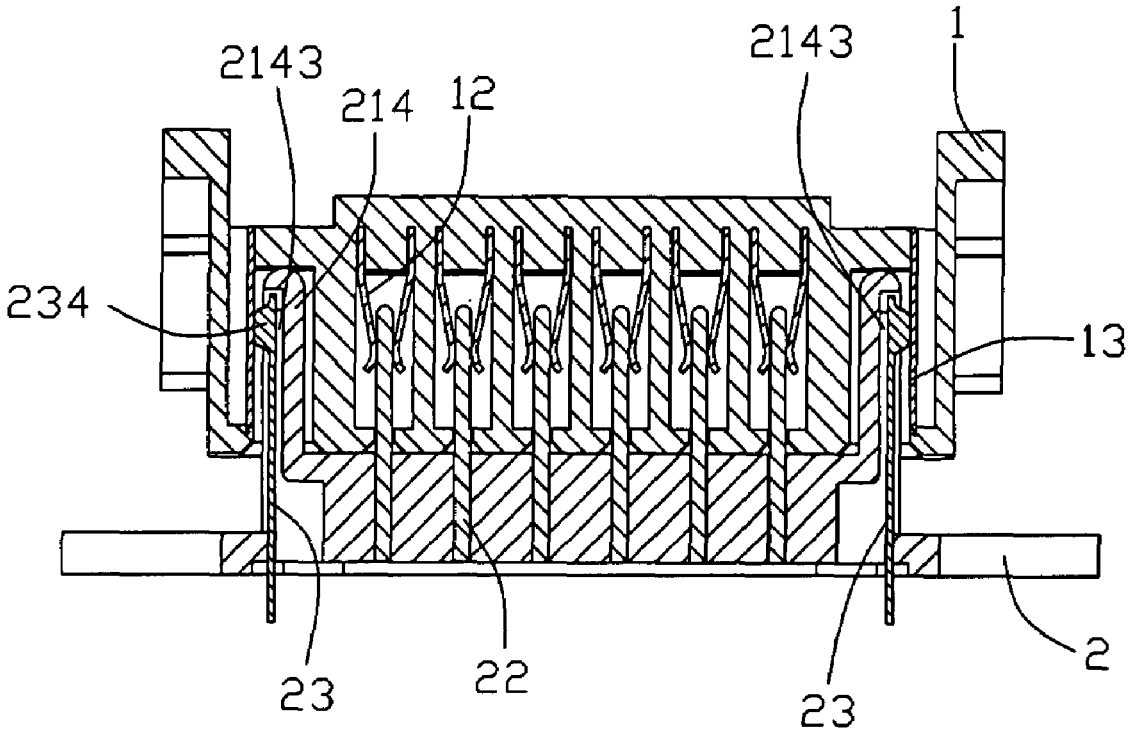
FIG. 4 is a cross-sectional views of FIG. 1 taken along line 4-4.

As best shown in FIG. 4, the header grounding contact 23 space apart the barrier 214 with a room 2143, thereby the blade shaped contact section of grounding contact are allowed to have a resilient room.

However, the disclosure is illustrative only, changes may be made in detail, especially in matter of shape, size, and arrangement of parts within the principles of the invention.

What is claimed is:

1. An electrical connector assembly comprising:

a header comprising:

an insulating housing defining at least one barrier unitarily extending upwards therefrom;

a plurality of header contacts being blade shaped, retained in the housing and arranged parallel to the at least one barrier; and at least one header grounding contact retained on one side of the barriers; and a socket matable with the header, comprising socket contacts and at least one socket grounding contact mated with the corresponding header contact and header grounding contact, and insulating housing defining socket-contact-receiving recesses and socket-grounding-receiving recesses parallel to each other; wherein when the header and the socket are mated with each other, the at least one barrier is inserted into corresponding socket-grounding-receiving recess, and the grounding contacts are electrically connected together before the header contacts and the socket contacts, wherein each of the at least one barrier defines a groove exposed outwards and run through the insulating housing to receive one header grounding contact;

wherein the groove is defined on an outer face of the barrier, wherein the header grounding contact and socket grounding contact both are blade shaped and the header grounding contact defines a protrusion projecting outwards for contacting the socket grounding contact, wherein the header grounding contact is resilient and a distance is defined between the contact section of the header grounding contact and the insulating housing for a resilient room of the header grounding contact.

2. The electrical connector assembly as described in claim 1, wherein the barrier is thicker than the header contact along a direction of the contacts arrayed.

3. The electrical connector assembly as described in claim 1, wherein the header grounding contact is longer than the header contact along an extending direction of the contact.

4. A electrical connector assembly comprising:

a first connector including a first insulating housing defining a first mating face and at least one barrier extending therefrom and beyond the first mating face;

a plurality of first contacts being blade shaped and parallel to the at least one barrier, said first contacts having front contacting sections under a condition that no portions of the first housing transversely separate the contacting sections of the neighboring contacts;

at least one grounding contact located in the barrier and exposed outwards;

a second connector including a second insulating housing defining a second mating face and a plurality of contact receiving recesses and at least one ground receiving recess parallel to each other; and a plurality of second contacts disposed in the corresponding contact receiving recesses, respectively, and a grounding terminal disposed in the ground receiving recess; wherein the first housing further includes two mounting portions extending outwardly at two opposite lengthwise ends for protecting the grounding contact.

* * * * *